US006767231B1

(12) United States Patent
Martin et al.

(10) Patent No.: US 6,767,231 B1
(45) Date of Patent: Jul. 27, 2004

(54) ELECTRICAL CONNECTOR WITH FLEXIBLE BLOCKING FEATURE

(75) Inventors: Galen M. Martin, Camp Hill, PA (US); Keith Richard Foltz, Duncannon, PA (US); James E. Gundermann, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/670,677

(22) Filed: Sep. 25, 2003

(51) Int. Cl.[7] ..... H01R 13/72
(52) U.S. Cl. ..... 439/157; 439/160; 439/372
(58) Field of Search ..... 439/157, 160, 439/372, 159, 152, 341

(56) References Cited

U.S. PATENT DOCUMENTS 5,205,752 A * 4/1993 Taguchi et al. ..... 439/157
5,263,871 A * 11/1993 Sano ..... 439/157
6,039,586 A * 3/2000 Kitamura ..... 439/157
6,186,804 B1 * 2/2001 Smith et al. ..... 439/157
6,312,272 B1 * 11/2001 Gaupp et al. ..... 439/157
6,325,647 B1 * 12/2001 May et al. ..... 439/157
6,439,902 B1 * 8/2002 Cole et al. ..... 439/157
6,485,317 B2 * 11/2002 Gundermann et al. ..... 439/157
6,558,176 B1 * 5/2003 Martin et al. ..... 439/157
6,638,085 B1 * 10/2003 Martin ..... 439/157
6,652,298 B2 * 11/2003 Ohnuki ..... 439/157

* cited by examiner

*Primary Examiner*—Ross Gushi
*Assistant Examiner*—Briggitte R. Hammond

(57) ABSTRACT

An electrical connector includes a first housing having a first set of electrical contacts and a second housing having a second set of electrical contacts. The first and second housing are configured to be matable with one another to mate the first set of contacts with the second set of contacts. The first and second housings are movable between an initial position wherein the first and second sets of electrical contacts are unmated and a final position wherein the respective first and second sets of electrical contacts are fully mated. A lever member is rotatably mounted to the first housing and configured to engage the second housing when rotated. The lever member is configured to move the first and second housings between the initial and final positions as the lever member is rotated when the lever and the second housing are initially aligned. The lever member includes at least one blocking beam configured to separate the first and second housings as the lever member is rotated when the lever member and the second housing are initially misaligned.

17 Claims, 10 Drawing Sheets

ELECTRICAL CONNECTOR WITH FLEXIBLE BLOCKING FEATURE

BACKGROUND OF THE INVENTION

The invention relates generally to electrical connectors and, more particularly, to a lever assist connector with a flexible blocking feature.

In certain applications, electronic components require the mating of several electrical contacts, such as in automotive electrical components. The electronic component includes a connector housing that holds several electrical contacts, while a mating connector housing holds an equal number of electrical contacts. One connector housing includes male electrical contacts, while the other connector housing includes female electrical contacts. As the number of electrical contacts to be mated increases, it becomes difficult to fully join the mating connector housings because of friction between the mating electrical contacts. The connector housings are formed with a mate assist assembly that includes a lever-and-gear system to pull together the connector housings in order to overcome the frictional resistance created by the mating electrical contacts.

One connector with a mate assist assembly is described in U.S. Pat. No. 6,558,176. The connector includes first and second connector housings having electrical contacts, and a lever member for mating the housings together. The first connector housing is configured to be positioned inside the second connector housing. The lever includes a handle and two arms extending therefrom that may be rotated alongside side walls of the first connector housing. The lever is placed in an initial or pre-latched position and the first connector housing and second connector housing are engaged sufficiently for the gear teeth to engage, after which the lever is rotated to complete the mating operation.

Although it is intended that final mating of the contacts be accomplished by rotation of the lever, it is possible to put the connector housings together with the lever in other than the initial position and apply enough force to establish at least partial electrical contact. The connector could later separate in service. Thus, a need exists for a mate assist assembly that prevents electrical engagement when the connector housings are not latched in the fully mated position.

BRIEF DESCRIPTION OF THE INVENTION

In one embodiment of the invention, an electrical connector includes a first housing having a first set of electrical contacts and a second housing having a second set of electrical contacts. The first and second housing are configured to be matable with one another to mate the first set of contacts with the second set of contacts. The first and second housings are movable between an initial position wherein the first and second sets of electrical contacts are unmated and a final position wherein the respective first and second sets of electrical contacts are fully mated. A lever member is rotatably mounted to the first housing and configured to engage the second housing when rotated. The lever member is configured to move the first and second housings between the initial and final positions as the lever member is rotated when the lever and the second housing are initially aligned. The lever member includes at least one blocking beam configured to separate the first and second housings as the lever member is rotated when the lever member and the second housing are initially misaligned.

Optionally, the blocking beam is configured to engage a mating post within the second housing and to flex to allow the first and second housings to move from the initial position to the final position when the lever member is aligned so that a first gear surface on the lever member engages the mating post.

In another embodiment of the invention, an electrical connector includes a first housing that has a first set of electrical contacts, and a lever member rotatably mounted thereto that includes at least one blocking beam. A second housing having a second set of electrical contacts is configured for mating engagement with the first housing. The second housing has a mating post located therein for engagement with the lever member. The mating post includes a first engagement surface and a second engagement surface. The lever member mates the first and second sets of contacts as the lever member is rotated when the lever member engages the first engagement surface of the mating post. The blocking beam prevents mating of the first and second contacts as the lever is rotated when the lever engages the second engagement surface.

DETAILED DESCRIPTION OF THE INVENTION

Figure 1:
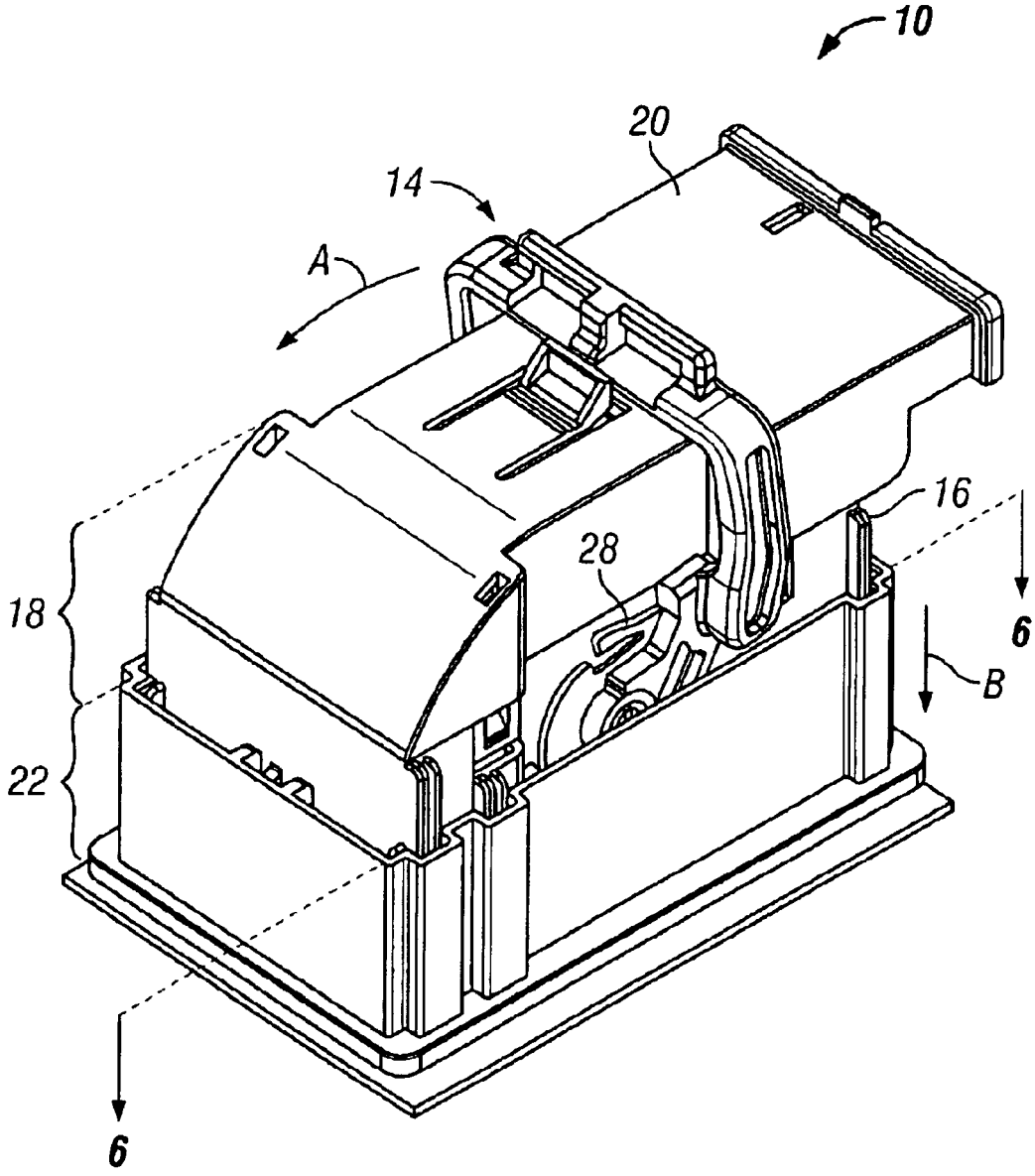
FIG. 1 illustrates a top perspective view of a mate assist connector assembly formed in accordance with an exemplary embodiment of the present invention.

FIG. 1 illustrates a top perspective view of an exemplary mate assist connector assembly 10 including a flexible blocking feature according to an embodiment of the present invention. The mate assist connector assembly 10 includes a harness connector 18 having a bottom portion 16 and a top portion 20. The bottom portion 16 is configured to receive packets that hold groups of electrical contacts while the top portion 20 covers the electrical contacts. A module connector 22 holds electrical contacts configured to mate with the electrical contacts in the harness connector 18. As illustrated in FIG. 1, the harness connector 18 is partially inserted within the module connector 22 to an initial staging position.

Figure 7:
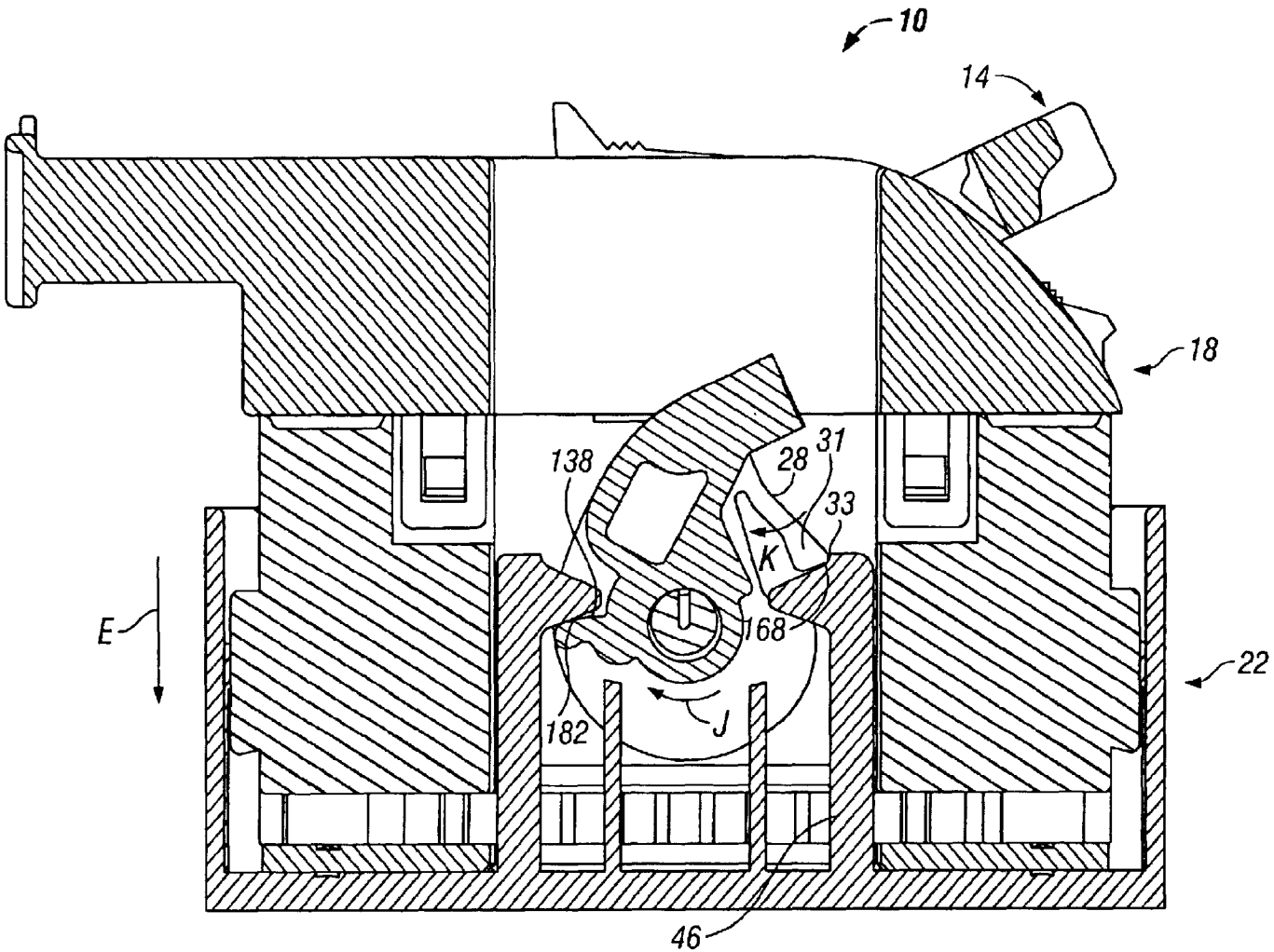
FIG. 7 is a cross-sectional view of the mate assist connector assembly of FIG. 1, taken along line 6—6, illustrating the connector assembly in a mating stage.

A lever member 14 is retained on the exterior of the harness connector 18 and engages the module connector 22. The lever member 14 is rotatable in the direction of arrow A from the initial staging position (FIG. 1) to a final position (FIG. 7). As the lever member 14 is rotated, it pushes the harness connector 18 downward in the direction of arrow B into the module connector 22 and fully mates the electrical contacts of the harness connector 18 and the module connector 22 with each other. If the lever member 14 is not properly positioned at the initial position, a blocking beam 28 on the lever member 14 engages the module connector 22 in a manner to move the harness connector 18 and the module connector 22 apart to inhibit the mating process. Thus, the blocking feature facilitates blocking the harness connector 18 and module connector 22 from mating to the point of electrical contact if the lever member 14 is not properly positioned at the initial staging position.

Figure 2:
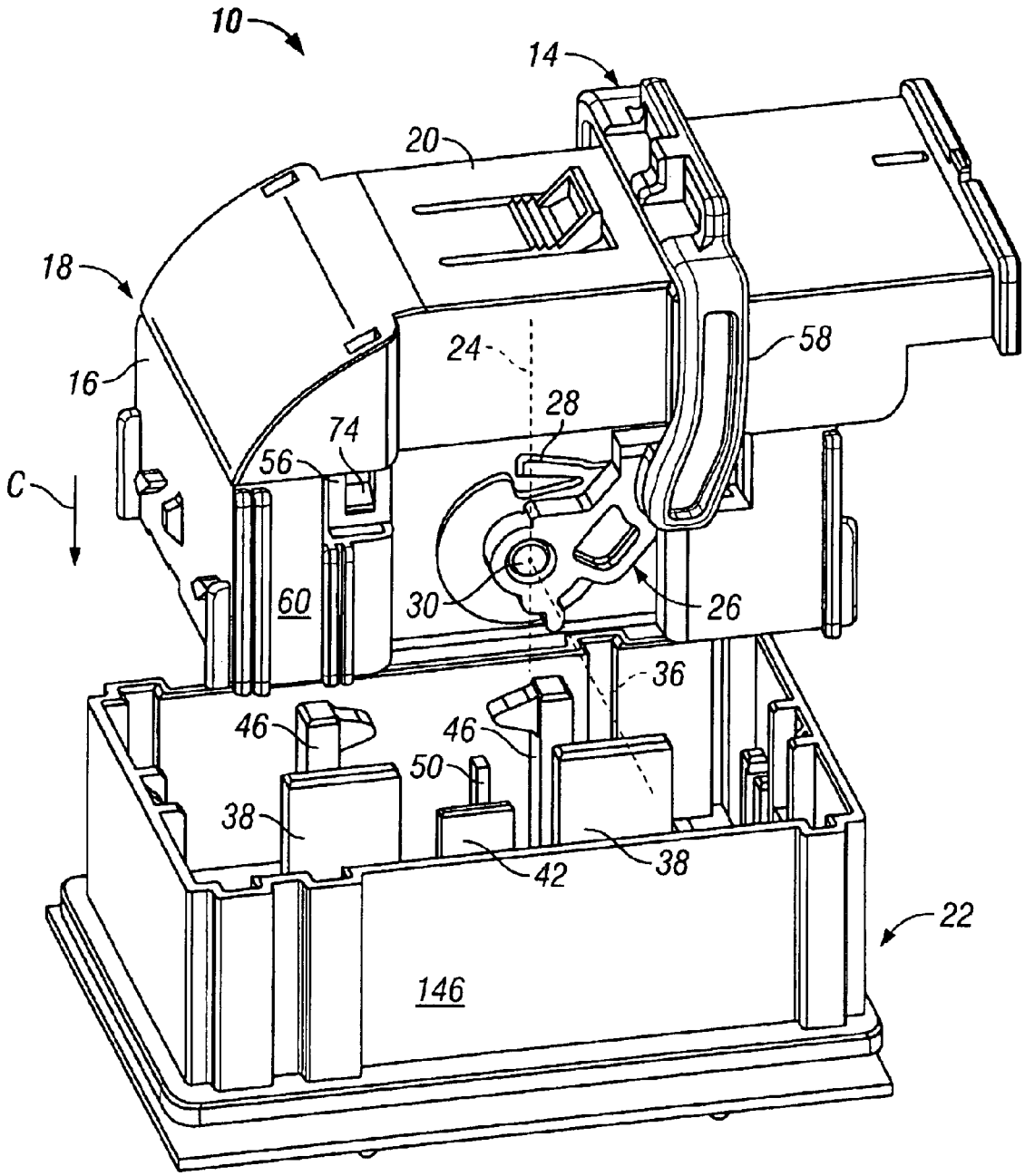
FIG. 2 illustrates an exploded view of the mate assist connector assembly of FIG. 1.

FIG. 2 illustrates an exploded view of the mate assist connector assembly 10 of FIG. 1. The lever member 14 includes cam arms 26 that rotate about pivot posts 30 extending outward from the harness connector 18 along a rotational axis 36. The lever member 14 is oriented in an unmated position with lever arms 58 aligned generally parallel to a vertical axis 24. The module connector 22 includes large alignment posts 38 and a small alignment post 42 formed in the center of the module connector 22. The module connector 22 also includes mating posts 46 facing each other and located alongside side walls 146. Release posts 50 (only one of which is shown) are positioned between the mating posts 46.

The top portion 20 and the bottom portion 16 of the harness connector 18 are fastened together by retention latches 56 extending from the top portion 20 and engaging latch catches 74 extending from side walls 60 of the bottom portion 16. The harness connector 18 and the lever member 14 are removably inserted downward in the direction of arrow C into the module connector 22 to the initial staging position shown in FIG. 1. When the harness connector 18 is in the initial staging position, each cam arm 26 is positioned between a pair of opposing mating posts 46 and above a pair of release posts 50, and the harness connector 18 slidably receives the alignment posts 38 and 42 within alignment recesses (not shown) located inside the harness connector 18.

Figure 3:
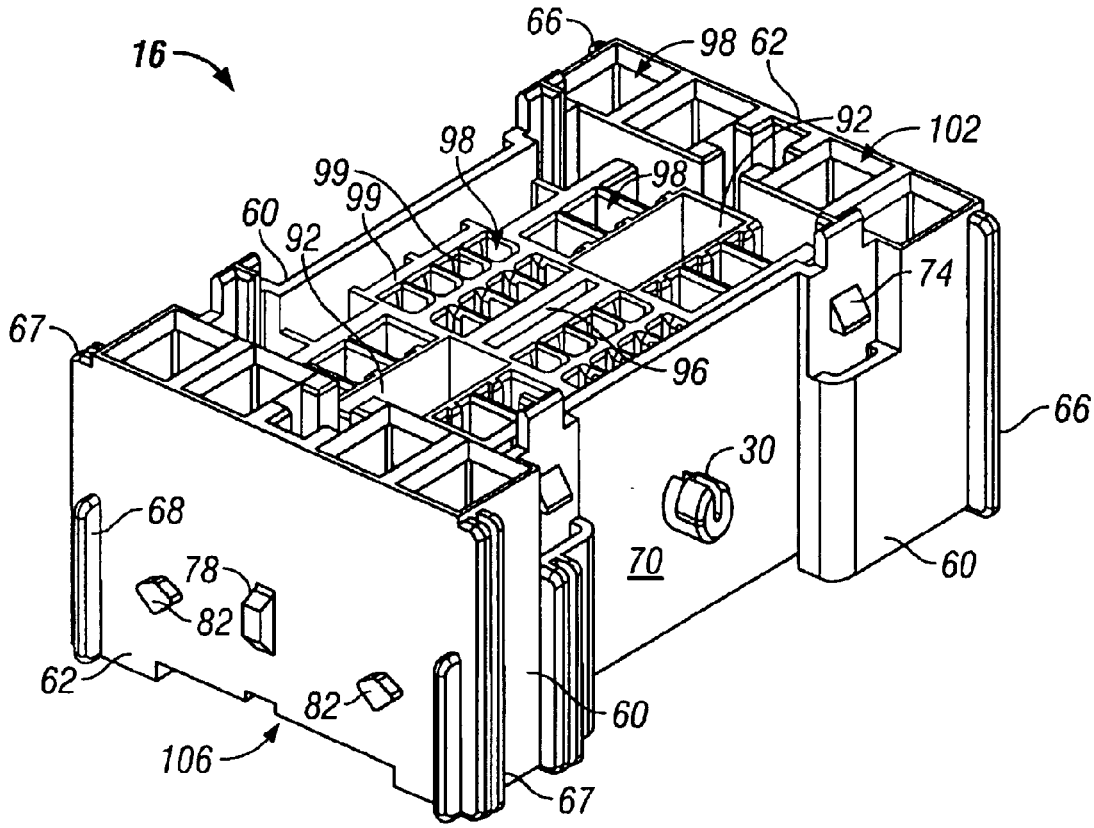
FIG. 3 illustrates a perspective view of the bottom portion of the harness connector of the mate assist connector assembly of FIGS. 1 and 2.

FIG. 3 illustrates a perspective view of the bottom portion 16 of the harness connector 18 of FIGS. 1 and 2. The bottom portion 16 is box shaped and includes opposing side walls 60 and opposing end walls 62. A perimeter around the exterior of the bottom portion 16 is smaller than an interior perimeter of the module connector 22 of FIGS. 1 and 2, in order that the harness connector 18 may be positioned within the module connector 22.

Securing rails 66 and 67 extend outward from opposite ends of the side walls 60. Double securing rails 67 are located on opposite sides at one end of the bottom portion 16 and a single securing rail 66 is located on opposite sides of an opposite end of the bottom portion 16. The securing rails 66 and 67 are slidably received by cavities 100 (FIG. 5) within the module connector 22 so that the bottom portion 16 does not slide transversely to the securing rails 66 and 67 within the module connector 22. The pivot posts 30 extend outward from the centers of recessed portions 70 of the side walls 60. Each cam arm 26 (FIG. 2) encloses and rotates about a pivot post 30 along a recessed portion 70. When the harness connector 18 is positioned within the module connector 22, the cam arms 26 are rotatable within a chamber defined by the recessed portion 70 and the module connector 22. The side walls 60 also include the triangular latch catches 74 that engage the retention latches 56 formed with the top portion 20.

Short securing rails 68 extend outward from the end walls 62 proximate opposite corners of the end walls 62. The short securing rails 68 are slidably received within the module connector 22 and engage end walls 150 (FIG. 5) of the module connector 22. Each end wall 62 also includes a retention wedge 78 located between two diamond shaped retention beams 82. The retention wedges 78 are received by retention channels 86 (FIG. 5) in the module connector 22 and engage wedge catches 90 (FIG. 5) positioned within the retention channels 86. The retention beams 82 engage an alignment plate (not shown) positioned within the module connector 22 (shown in FIG. 1). As the bottom portion 16 is inserted into the module connector 22, the retention wedges 78 and retention beams 82 slide past the wedge catches 90 and beam catches 94, respectively, so that the bottom portion 16 is retained within the module connector 22.

The bottom portion 16 includes several connector pockets 98 of varying shapes and sizes formed with walls 99 extending from the side and end walls 60 and 62. The connector pockets 98 extend throughout the harness connector 16 from an open top section 102 to an open bottom section 106. The connector pockets 98 hold the electrical contacts that are mated with the electrical contacts contained within the module connector 22. Centered within the bottom portion 16 between sets of connector packets 98 is a small alignment recess 96 situated between large alignment recesses 92. The small and large alignment recesses 96 and 92 extend through the harness connector 16 and receive and enclose the small and large alignment posts 42 and 38 (FIG. 2) mounted in the module connector 22 when the harness connector 18 is positioned within the module connector 22.

Figure 4:
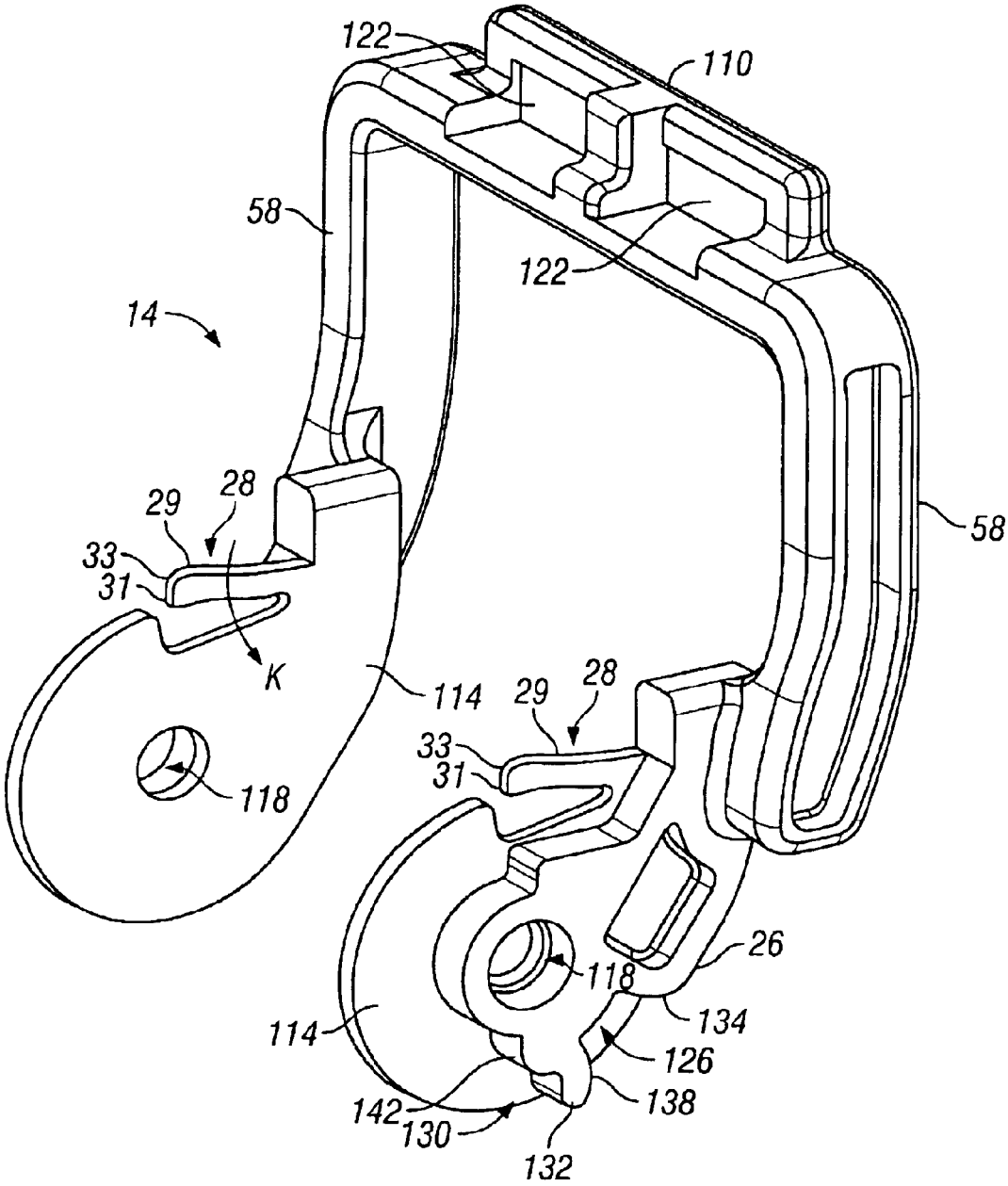
FIG. 4 illustrates a perspective view of an exemplary lever member according to an embodiment of the present invention.

FIG. 4 illustrates a perspective view of the lever member 14 in more detail. A handle 110 is formed integral with, and extends perpendicularly between, the lever arms 58, which are in turn formed with the cam arms 26. Circular contact bases 114 extend along the insides of the cam arms 26, and retention apertures 118 extend through the cam arms 26 and contact bases 114. The lever member 14 is attached to the harness connector 18 by deflecting the lever arms 58 outward away from each other so that the contact bases 114 slide along the pivot posts 30 (FIG. 2) until the pivot posts 30 are enclosed within the retention apertures 118. The lever member 14 is then rotatable about the rotational axis 36 (FIG. 2) with the contact bases 114 slidably engaging the recessed portions 70 (FIG. 3) of the harness connector 18. The handle 110 includes two grip surfaces 122 that an operator may use to rotate the lever member 14.

Each contact base 114 includes one of the blocking beams 28. In one embodiment, the blocking beams 28 are integrally formed in the contact base 114. Each blocking beam 28 has a free end 29 that includes a heel portion 31 and a bevel 33 proximate the heel portion 31. The blocking beams 28 are deflectable in the direction of arrow K during the mating process to allow fill engagement of the harness connector 18 and the module connector 22 when the lever member 14 is properly oriented at the initial staging position as will be described.

Figure 8:
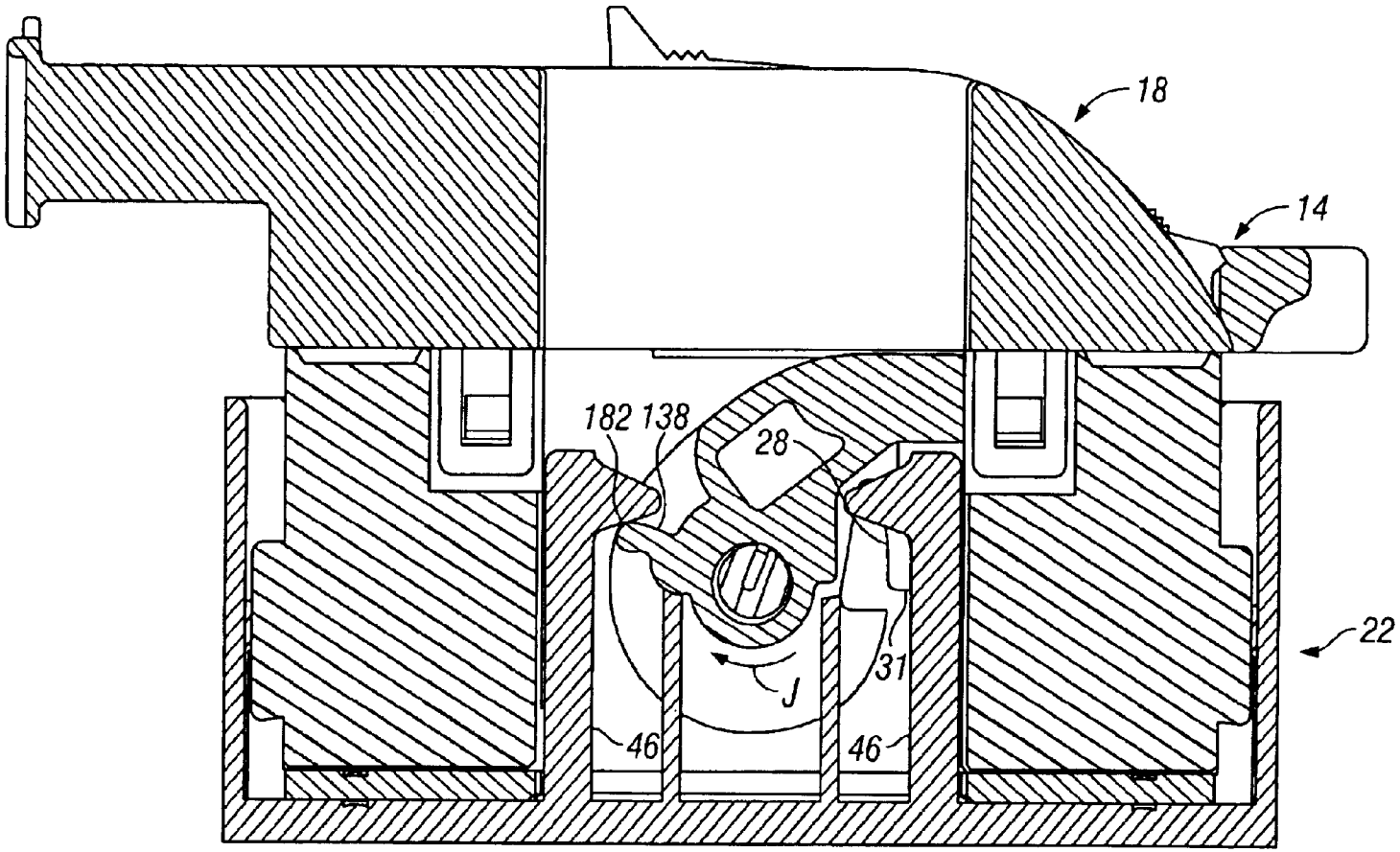
FIG. 8 is a cross-sectional view of the mate assist connector assembly of FIG. 1, taken along line 6—6, illustrating the connector assembly in the final position.

Each cam arm 26 includes a first notch 126 adjacent a second notch 130 along a gear tooth 132 formed in the peripheral surface of the cam arm 26. The first notch 126 includes a first ungearing surface 134 located across from a gearing surface 138 on the gear tooth 132. When the lever member 14 is rotated to move the mate assist connector assembly 10 from the initial staging position to the final position (as shown in FIG. 8), the gearing surfaces 138 engage the mating posts 46 (FIG. 2) as described below. Alternatively, when the lever member 14 is rotated to move the mate assist connector assembly 10 from the final position to the initial staging position, the first ungearing surfaces 134 engage the mating posts 46 as described below.

The second notch 130 of each cam arm 26 is partially defined by a second ungearing surface 142. When the lever member 14 is rotated to move the mate assist connector assembly 10 from the final position to the initial staging position, the second ungearing surfaces 142 engage the release posts 50 (FIG. 2) situated alongside the mating posts 46.

Figure 5:
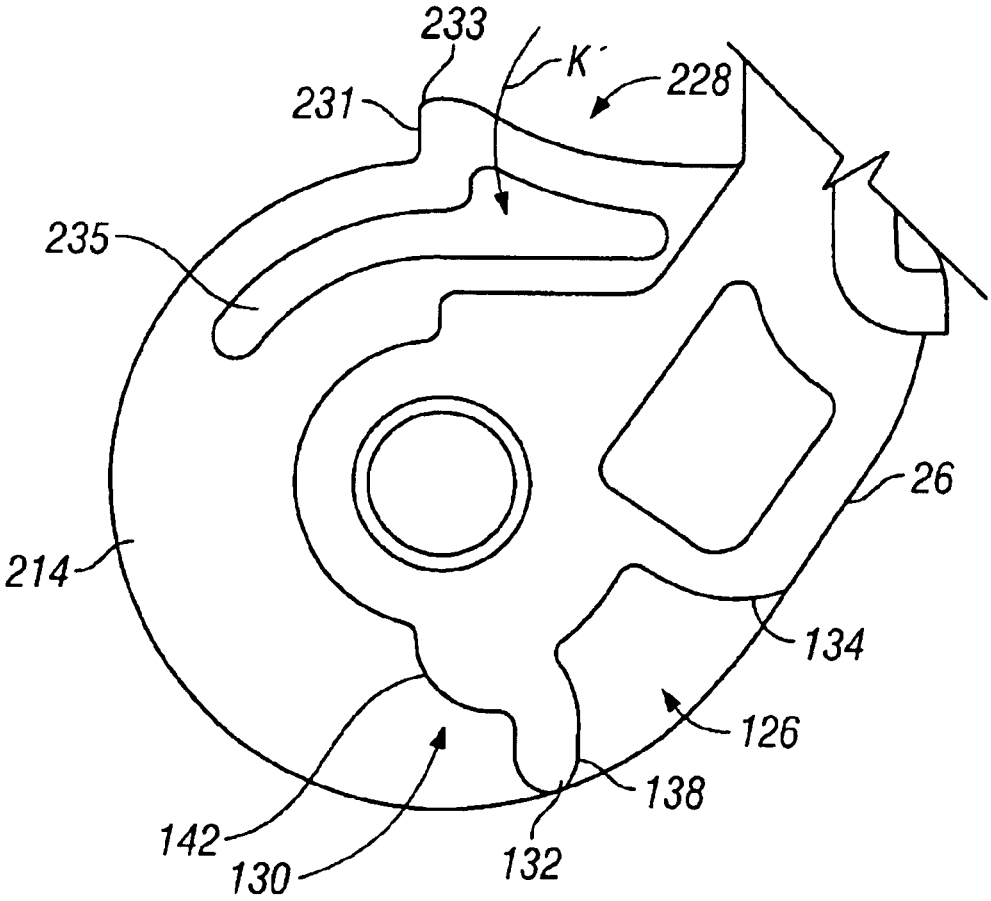
FIG. 5 is a partial side view of a lever member illustrating a contact base and a blocking beam formed according to an alternative embodiment of the present invention.

FIG. 5 is a partial side view of a lever member illustrating a contact base 214 and a blocking beam 228 formed according to an alternative embodiment of the present invention. With the exception of the contact base 214 and the blocking beam 228, the features shown are identical to the corresponding feature of FIG. 4 and are numbered correspondingly.

The blocking beam 228 is formed integrally with the contact base 214. The blocking beam 228 is deflectable in the direction of arrow K' into a slot 235 formed in the contact base 214. The blocking beam 228 has a heel portion 231 and a bevel 233 proximate the heel portion 231. The blocking beam 228 is deflectable in the direction of the arrow K' during the mating process when the lever member 14 (see FIG. 4) is properly oriented at the initial staging position as described above.

Figure 6:
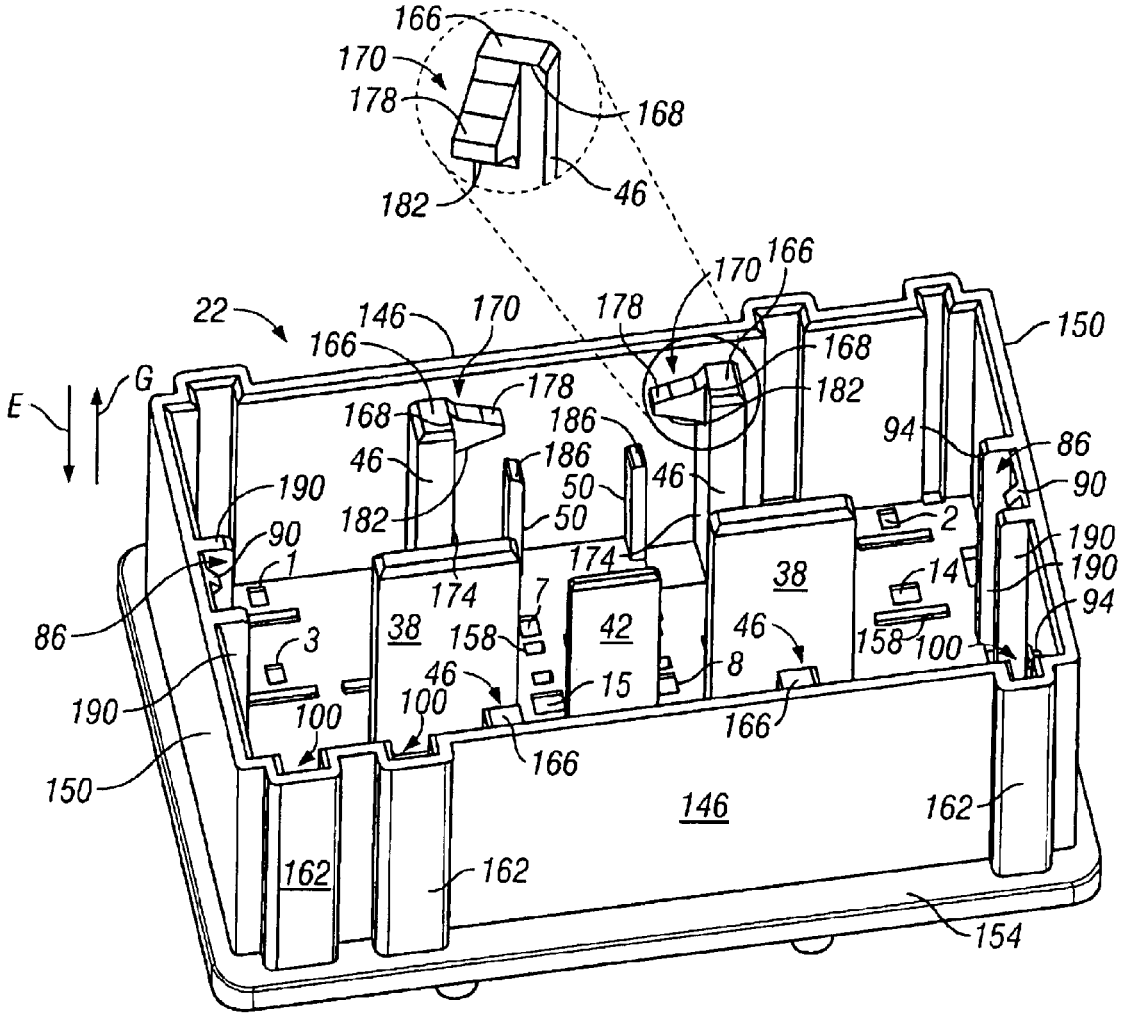
FIG. 6 illustrates a perspective view of the module connector of the mate assist connector assembly of FIGS. 1 and 2.

FIG. 6 illustrates an isometric view of the module connector 22. The two side walls 146 are formed integral with, and are aligned perpendicular to, the end walls 150. The side and end walls 146 and 150 are formed integral with, and extend from, a base 154, which has a larger perimeter than a perimeter about the side and end walls 146 and 150. The base 154 is mounted to an electronic component (not shown), such as a radio, with the side and end walls 146 and 150 extending outward from the electronic component. Several contact slots 158 of varying sizes and shapes extend through the base 154. The electrical contacts positioned within the module connector 22 are connected to the electronic component through the contact slots 158. The large alignment posts 38 and small alignment post 42 extend upward from the center of the base 154.

The side walls 146 each include rail chambers 162 along the exteriors of the side walls 146 that define cavities 100 along the interiors of the side walls 146. The rail chambers 162 are appropriately situated along each side wall 146 so that when the harness connector 18 is positioned within the module connector 22, the cavities 100 receive corresponding securing rails 66 and 67 situated on the side walls 60 of the harness connector 18 (FIG. 4). Thus the rail chambers 162 retain the securing rails 66 and 67 and guide the harness connector 18 into the module connector 22 in the proper orientation.

The mating posts 46 and the release posts 50 extend inward from the side walls 146 along the base 154. Two mating posts 46 extending from one side wall 146 face each other and are oriented opposite two mating posts 46 extending from the other side wall 146. Similarly, two release posts 50 extend from one side wall 146 between the mating posts 46 oriented opposite two release posts 50 extending from the other side wall 146. Each side wall 146 includes mating posts 46 and release posts 50 so that the lever member 14 and the top portion 20 (FIG. 2) of the harness connector 18 may be connected to the bottom portion 16 in either one of two orientations with each cam arm 26 still engaging a mating post 46 and a release post 50 when the harness connector 18 is inside the module connector 22.

The mating posts 46 are rectangular in shape and include flat top surfaces 166. A wedge shaped tooth 170 extends from an inside wall 174 of each mating post 46 proximate the top surface 166. The tooth 170 includes a top portion or first engagement surface 178 that extends downward at an acute angle from the top surface 166 to a bottom portion or second engagement surface 182 that extends upward from, and at an obtuse angle to, the inside wall 174. The top surfaces 166 include a stop edge 168 interiorly and adjacent each tooth 170. In operation, when the cam arms 26 (FIG. 4) are rotated to move the mate assist connector assembly 10 from the initial staging position to the final position, the gearing surfaces 138 (FIG. 4) engage, and are resisted by, the bottom portions 182, pulling the cam arms 26 downward in the direction of arrow E. The heel portion 31 of the blocking beam 28 engages the stop edge 168 of the mating post 46, and if the lever 14 is properly positioned, the bevel 33 on the blocking beam 28 induces the blocking beam 28 to flex sufficiently to allow the mate assist connector assembly 10 to move to the final position. When the cam arms 26 are rotated to move the mate assist connector assembly 10 from the final position to the initial staging position, the first ungearing surfaces 134 (FIG. 4) engage, and are resisted by, the top portions 178, pushing the cam arms 26 upward in the direction of arrow G.

The release posts 50 are rectangular in shape and include flat top surfaces 186 that slope downward in the direction of the other release post 50 along the same side wall 146. In operation, when the cam arms 26 are rotated to move the mate assist connector assembly 10 from the final position to the initial staging position, the second ungearing surfaces 142 (FIG. 4) engage, and are resisted by, the top surfaces 186, pushing the cam arms 26 upward in the direction of arrow G.

Each end wall 150 includes two guide walls 190 that extend inwardly and perpendicularly from the end wall 150 parallel to each other. The two guide walls 190 and the end wall 150 define the retention channel 86 that receives a retention wedge 78 (FIG. 3). The beam catches 94 extend inward from the end walls 150 alongside the guide walls 190. The wedge catches 90 are located between the guide walls 190 within the retention channels 86 so that the retention wedges 78 slide downward past, and are retained under, the wedge catches 90 as the harness connector 18 is inserted downward into the module connector 22.

Figure 9:
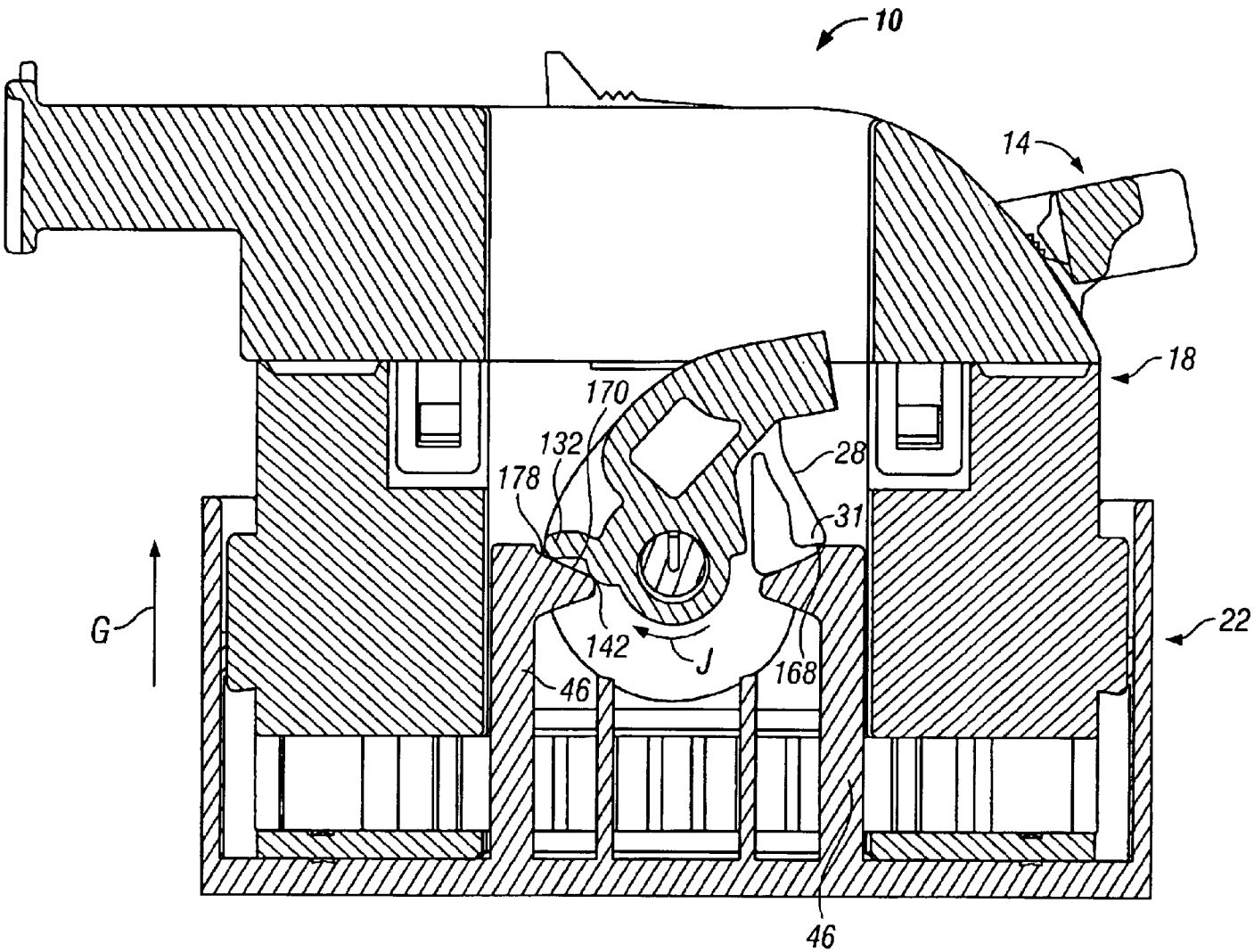
FIG. 9 is a cross-sectional view of the mate assist connector assembly of FIG. 1, taken along line 6—6, illustrating the connector assembly with the lever member improperly positioned for mating.

With reference to FIGS. 7 through 9, the operation of the blocking feature will be described in detail. The blocking feature facilitates blocking the harness connector 18 and the module connector 22 from mating to the point of electrical contact when the lever member 14 is not positioned at the initial stage to facilitate proper engagement of the gearing surfaces 138 and 182.

FIG. 7 is a cross-sectional view of the mate assist connector assembly of FIG. 1, taken along line 6—6, illustrating the connector assembly in a mating stage with the gearing surface 138 engaging the bottom portion 182 of the tooth 170. The harness connector 18 is partially drawn into the module connector 22. From this condition, proper mating will occur. The bevel 33 at the heel portion 31 of the blocking beam 28 is engaged with the stop edge 168 of the mating post 46. With continued rotation of the lever member 14 in the direction of arrow J, the bevel 33 induces the blocking beam 28 to deflect inwardly in the direction of arrow K, sliding off the stop edge 168 and allowing the mating process to continue. As the lever member is rotated, the gearing action between the gearing surface 138 and the bottom portion 182 of the tooth 170 urges the harness connector 18 downward in the direction of arrow E and into the module connector 22.

FIG. 8 is a cross-sectional view of the mate assist connector assembly of FIG. 1, taken along line 6—6, illustrating the connector assembly 10 fully mated in the final seated position. The harness connector 18 is fully seated within the module connector 22 and electrical engagement between the connectors 18 and 22 is established.

FIG. 9 is a cross-sectional view of the mate assist connector assembly 10 of FIG. 1, taken along line 6—6, illustrating the connector assembly with the lever member improperly positioned for mating. As shown, the harness connector 18 has been inserted into the module connector 22. However, the lever member 14 was not sufficiently vertical at the start of the operation. As a result, the gear tooth 132 along with ungearing surface 142 are engaged with the top portion 178 of the tooth 170 on the mating post 46. In addition, the heel portion 31 of the blocking beam 28 is engaged with the stop edge 168 of the post top surface 166. In this position, the blocking beam is not induced to flex, rather, the blocking beam is an impediment to further seating of the connectors 18 and 22. Upon further rotation of the lever member 14 in the direction of arrow J, the heel portion 31 of the blocking beam 28 is forced against the top surface 166 of the mating post 46 so that the lever member 14 pivots about the heel portion 31 of the blocking beam 28 lifting the harness connector 18 upward in the direction of arrow G, away from the module connector 22.

Figure 10:
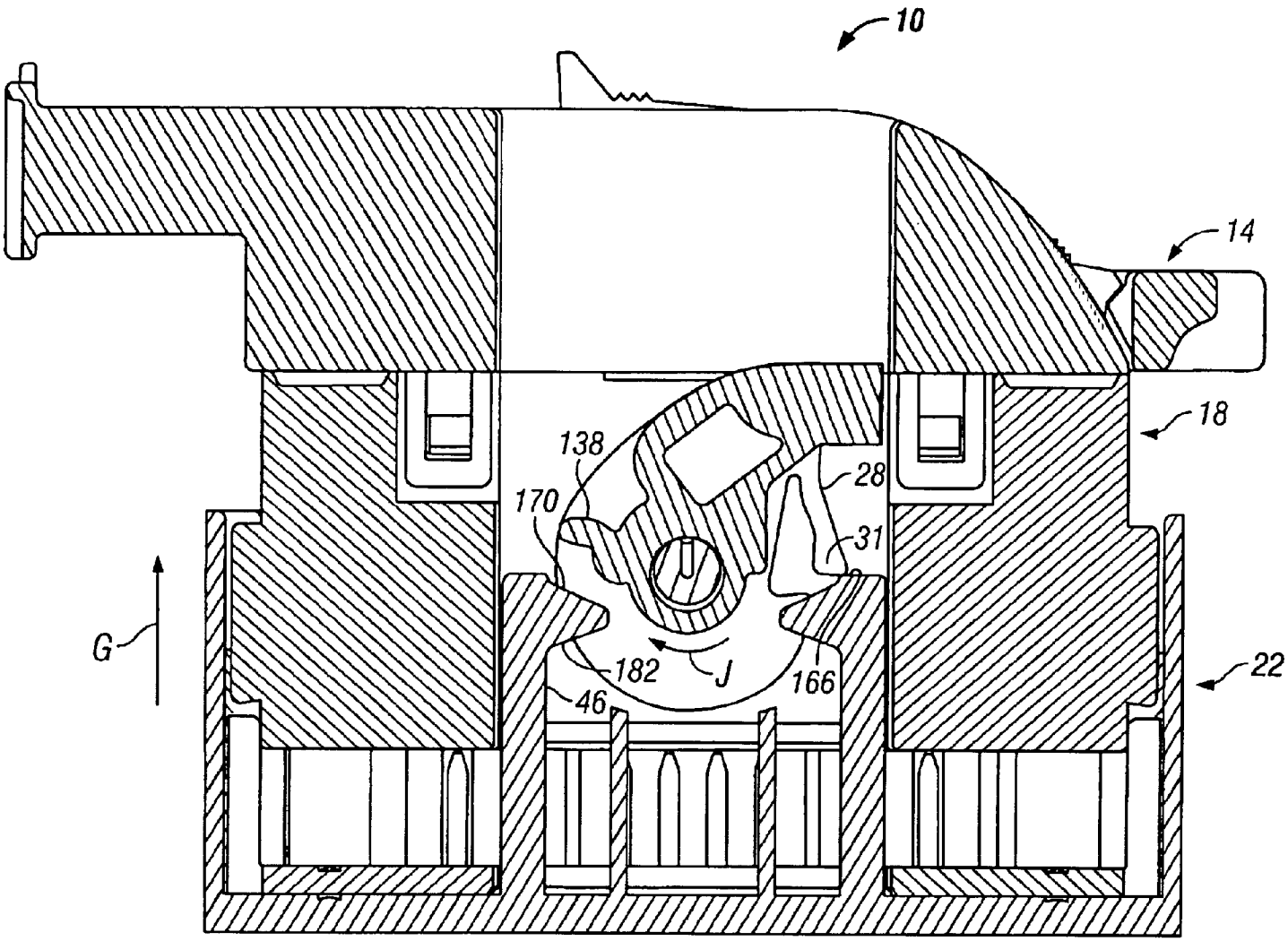
FIG. 10 is a cross-sectional view of the mate assist connector assembly of FIG. 1, taken along line 6—6, illustrating the connector assembly with the blocking feature inhibiting electrical engagement.

FIG. 10 illustrates a cutaway side view of the mate assist connector assembly 10 of FIG. 1 with the blocking feature inhibiting electrical engagement. From FIG. 9, continued rotation of the lever member 14 in the direction of arrow J results in the condition shown in FIG. 10. Since the lever member 14 was not properly positioned at the initial stage, gearing surface 138 is not engaged with bottom portion 182 of tooth 170 such that the rotation of the lever member 14 could'not achieve final mating of the harness connector 18 with the module connector 22. Rather, the heel portion 31 of the blocking beam 28 is impacted against the top surface 166 of the mating post 46 which results in the harness connector 18 being pulled in the direction of arrow G, away from the module connector 22 with rotation of the lever member 14 in the direction of arrow J. This provides a visual and tactile indication to a technician that the connectors 18 and 22 are not properly mated, and also inhibits electrical engagement between the connectors 18 and 22.

The embodiments thus described provide a mate assist connector assembly with a flexible blocking feature that provides both a visual and tactile indication when the connectors are not properly mated by urging the connectors apart instead of drawing the connectors together as the lever member is rotated. The assembly also facilitates inhibiting electrical engagement between the connectors when proper mating is not achieved, thus reducing the potential for in-service failures due to improper mating of the connectors.

While the invention has been described in terms of various specific embodiments, those skilled in the art will recognize that the invention can be practiced with modification within the spirit and scope of the claims.

What is claimed is:

1. An electrical connector comprising:

a first housing having a first set of electrical contacts therein;

a second housing having a second set of electrical contacts therein;

said first and second housing configured to be matable with one another to mate said first set of contacts with said second set of contacts, said first and second housings being movable between an initial position wherein said first and second sets of electrical contacts are unmated and a final position wherein said respective first and second sets of electrical contacts are fully mated; and a lever member rotatably mounted to said first housing and configured to engage said second housing when rotated, said lever member configured to move said first and second housings between said initial and final position as said lever member is rotated when said lever and said second housing are initially aligned, said lever member comprising at least one blocking beam configured to separate said first and second housings as said lever member is rotated when said lever member and said second housing are initially misaligned.

2. The electrical connector of claim 1 wherein said second housing comprises a mating post therein and said blocking beam is configured to engage said mating post and to flex to allow said first and second housings to move from said initial position to said final position when said lever member is aligned so that a first gear surface on said lever member engages said mating post.

3. The electrical connector of claim 1 wherein second housing comprises a mating post therein and said blocking beam includes a heel portion configured to engage a stop edge on said mating post.

4. The electrical connector of claim 1 wherein second housing comprises a mating post therein, said mating post including a stop edge, and said blocking beam includes a heel portion and a bevel proximate said heel portion, said heel portion configured to engage said stop edge on said mating post and said bevel facilitating movement of said heel portion out of engagement with said stop edge when said lever member is aligned so that a first gear surface on said lever member engages said mating post.

5. The electrical connector of claim 1 wherein said lever member further comprises a cam arm including first and second gear surfaces, said first gear surface configured to engage said second housing to move said first and second housings from said initial position to said final position as said lever member is rotated.

6. The electrical connector of claim 1 wherein said lever member further comprises a retention aperture rotatably engaging a pivot post extending from exterior side walls of said first housing.

7. The electrical connector of claim 1 wherein said second housing comprises a mating post within an interior thereof and said lever member further comprises a cam arm including first and second gear surfaces, and a peripheral surface having notches therein, said first and second gear surfaces located along a wall within said notches, said first gear surface configured to engage a bottom portion of said mating post.

8. The electrical connector of claim 1 wherein said second housing comprises a mating post within an interior thereof and said lever member further comprises a cam arm including first and second gear surfaces, said mating post including a cam tooth configured to engage said first gear surface.

9. The electrical connector of claim 1, wherein said lever member includes a cam arm and extends from opposite exterior side walls of said first housing between opposite interior side walls of said second housing from which extends opposing said first and said second mating posts, said cam arm rotating between and engaging opposing said first and second mating posts.

10. An electrical connector comprising:

a first housing having a first set of electrical contacts therein, and a lever member rotatably mounted thereto, said lever member comprising at least one blocking beam; and a second housing having a second set of electrical contacts therein, said second housing configured for mating engagement with said first housing, said second housing having a mating post located therein for engagement with said lever member, said mating post comprising a first engagement surface and a second engagement surface;

said lever member mating said first and second sets of contacts as said lever member is rotated when said lever member engages said second engagement surface of said mating post; and said blocking beam preventing mating of said first and second contacts as said lever member is rotated when said lever member engages said first engagement surface.

11. The electrical connector of claim 10, wherein said blocking beam is configured to flex to allow said first and second housings to move from said initial position to said final position when said lever member engages said second engagement surface of said mating post.

12. The electrical connector of claim 10, wherein said blocking beam includes a heel portion configured to engage a stop edge on said mating post.

13. The electrical connector of claim 10, wherein said blocking beam includes a heel portion and a bevel proximate said heel portion, said bevel facilitating movement of said heel portion out of engagement with a stop edge on said mating post when said lever member engages said second engagement surface of said mating post.

14. The electrical connector of claim 10 wherein said blocking bean includes a heel portion configured to engage a stop edge on said mating post to separate said first and second housings as said lever member is rotated when said lever member engages said first engagement surface of said mating post.

15. The electrical connector of claim 10 wherein said lever member includes at least one retention aperture rotatably engaging a pivot post extending from exterior side walls of said first housing.

16. The electrical connector of claim 10 wherein said lever member further comprises a cam arm including first and second gear surfaces within a notch formed in a peripheral surface of said cam arm, said first gear surface configured to engage said second engagement surface of said mating post, and said second gear surface configured to engage an engagement surface of a second mating post within said second housing.

17. The electrical connector of claim 10, wherein said mating post includes a cam tooth, said first engagement surface comprising a top portion of said cam tooth and said second engagement surface comprising a bottom portion of said cam tooth.

* * * * *